US012655694B2

(12) United States Patent
Zhan et al.

(10) Patent No.: US 12,655,694 B2
(45) Date of Patent: Jun. 16, 2026

(54) REFRESHABLE POLYCRYSTALLINE DIAMOND COMPACT (PDC) DRILL BITS

(71) Applicant: SAUDI ARABIAN OIL COMPANY, Dhahran (SA)

(72) Inventors: Guodong Zhan, Dhahran (SA); Jianhui Xu, Dhahran (SA); Abdulwahab S. Al-Johar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/040,660

(22) Filed: Jan. 29, 2025

(65) Prior Publication Data

US 2025/0172046 A1 May 29, 2025

Related U.S. Application Data

(62) Division of application No. 17/655,132, filed on Mar. 16, 2022, now Pat. No. 12,270,256.

(51) Int. Cl.

| | |
|---|---|
| ***E21B 10/62*** | (2006.01) |
| ***E21B 10/42*** | (2006.01) |
| ***E21B 10/55*** | (2006.01) |
| ***E21B 10/567*** | (2006.01) |

(52) U.S. Cl.

CPC ..... *E21B 10/62* (2013.01); *E21B 10/42* (2013.01); *E21B 10/55* (2013.01); *E21B 10/567* (2013.01)

(58) Field of Classification Search

CPC ..... E21B 10/42; E21B 10/55; E21B 10/567; E21B 10/62

See application file for complete search history.

(56) References Cited

U.S. PATENT DOCUMENTS

| | | | | |
|---|---|---|---|---|
| 6,142,250 | A * | 11/2000 | Griffin | E21B 44/005 175/426 |
| 2012/0261190 | A1 | 10/2012 | Krueger, IV | |
| 2015/0226010 | A1* | 8/2015 | Drews | E21B 29/00 175/432 |
| 2020/0386056 | A1* | 12/2020 | Grosz | E21B 10/20 |

OTHER PUBLICATIONS

Non-Final Office Action issued in related U.S. Appl. No. 19/040,649 dated Sep. 8, 2025 (10 pages).

* cited by examiner

*Primary Examiner* — Caroline N Butcher

(74) *Attorney, Agent, or Firm* — Osha Bergman Watanabe & Burton LLP

(57) ABSTRACT

A cutter system for a polycrystalline diamond compact (PDC) drill bit including a body, a static blade attached to the body, and a rotatable blade attached to the body. The cutter system further includes at least one PDC cutting structure attached to the rotatable blade. The rotatable blade is configured to be rotated and maintained in a rotated position. The body includes a cavity cooperatively positioned angularly away from the static blade. The rotatable blade rotates into the cavity. The rotatable blade has at least one incrementally rotated rest position. The cavity includes a restricting device within said cavity, so that said restricting device engages said rotatable blade member in the incrementally rotated position.

10 Claims, 7 Drawing Sheets

REFRESHABLE POLYCRYSTALLINE DIAMOND COMPACT (PDC) DRILL BITS

BACKGROUND

The disclosure relates generally to drilling of holes from the surface of the earth to subterranean reservoirs. Fluids are typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrocarbon reservoir may include natural gas, oil, and water.

A polycrystalline diamond compact (PDC) bit is a drill bit that uses synthetic diamond disks, called "cutters," to shear through rock with an ongoing scraping motion. The cutter has clusters of diamond grains that are aggregated into larger masses of crystals with random orientations. The PDC bit is used in drilling boreholes into the subterranean formation to form the wellbore. Those skilled in the art will readily appreciate that the term "compact" is a metallurgical term meaning "a mass of powdered metal compacted together in preparation for sintering."

PDC bits have been widely used in drilling various formations from soft to hard, from brittle to tough, in shallow to deep wells. The PDC cutters are the main cutting elements to shear off the formation with the clockwise rotation of the bottom hole assembly (BHA) energized by the downhole motor and/or surface motor. The PDC cutters are brazed to the bit body on the predominantly right (front) sides of the blades. Some other PDC cutters are brazed on the tops and sides of the blades to provide several different functions including the controlled depth of cut, secondary cutting, and protection of the blade or the primary cutters. There is, however, no PDC cutter on the left (back) sides of the blades due to the traditionally right (clockwise) turn of a drill string during drilling. When it is determined to change the bit due to the low rate of penetration (ROP) or predicted formation change, the bottom hole assembly (BHA) needs to be pulled out of the hole, and this requires a time-consuming tripping process to pull out the entire BHA from the wellbore. For example, when the drill bit is at about 12,000 feet (ft) total depth, approximately two days are required for the tripping to change the drill bit and the BHA.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the invention relate to a cutter system for a polycrystalline diamond compact (PDC) drill bit, the cutter system comprising: a body; a static blade attached to the body; a translatable blade attached to the body; and at least one PDC cutting structure attached to the translatable blade, wherein the translatable blade is configured to be translated and maintained in a translated position, wherein the body includes a cavity cooperatively positioned angularly away from the static blade, wherein the translatable blade translates into the cavity, wherein the translatable blade has a substantially retracted rest position and a substantially extended rest position, and wherein the cavity includes a restricting device within said cavity, so that said restricting device engages said translatable blade member in the substantially retracted position or the substantially extended position.

In one aspect, embodiments of the invention relate to a method for refreshing a drill bit, the method comprising: providing a drill bit with refreshing blades, wherein the refreshing blades are configured to move into a cutting position upon receipt of a signal; performing drilling operations within a well; obtaining, using a computer processor, drilling data; determining, using the computer processor, a relative aggressiveness of the drill bit; and comparing, using the computer processor, the relative aggressiveness of the drill bit with a target minimum aggressiveness of the drill bit, and controlling the moving of the refreshing blades into the cutting position in the drill bit in response to a result of the comparing of the relative aggressiveness of the drill bit with the target minimum aggressiveness of the drill bit.

In one aspect, embodiments of the invention relate to a cutter system for a polycrystalline diamond compact (PDC) drill bit, the cutter system comprising: a body; a static blade attached to the body; a rotatable blade attached to the body; and at least one PDC cutting structure attached to the rotatable blade, wherein the rotatable blade is configured to be rotated and maintained in a rotated position, wherein the body includes a cavity cooperatively positioned angularly away from the static blade, wherein the rotatable blade rotates into the cavity, wherein the rotatable blade has at least one incrementally rotated rest position, wherein the cavity includes a restricting device within said cavity, so that said restricting device engages said rotatable blade member in the incrementally rotated position.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
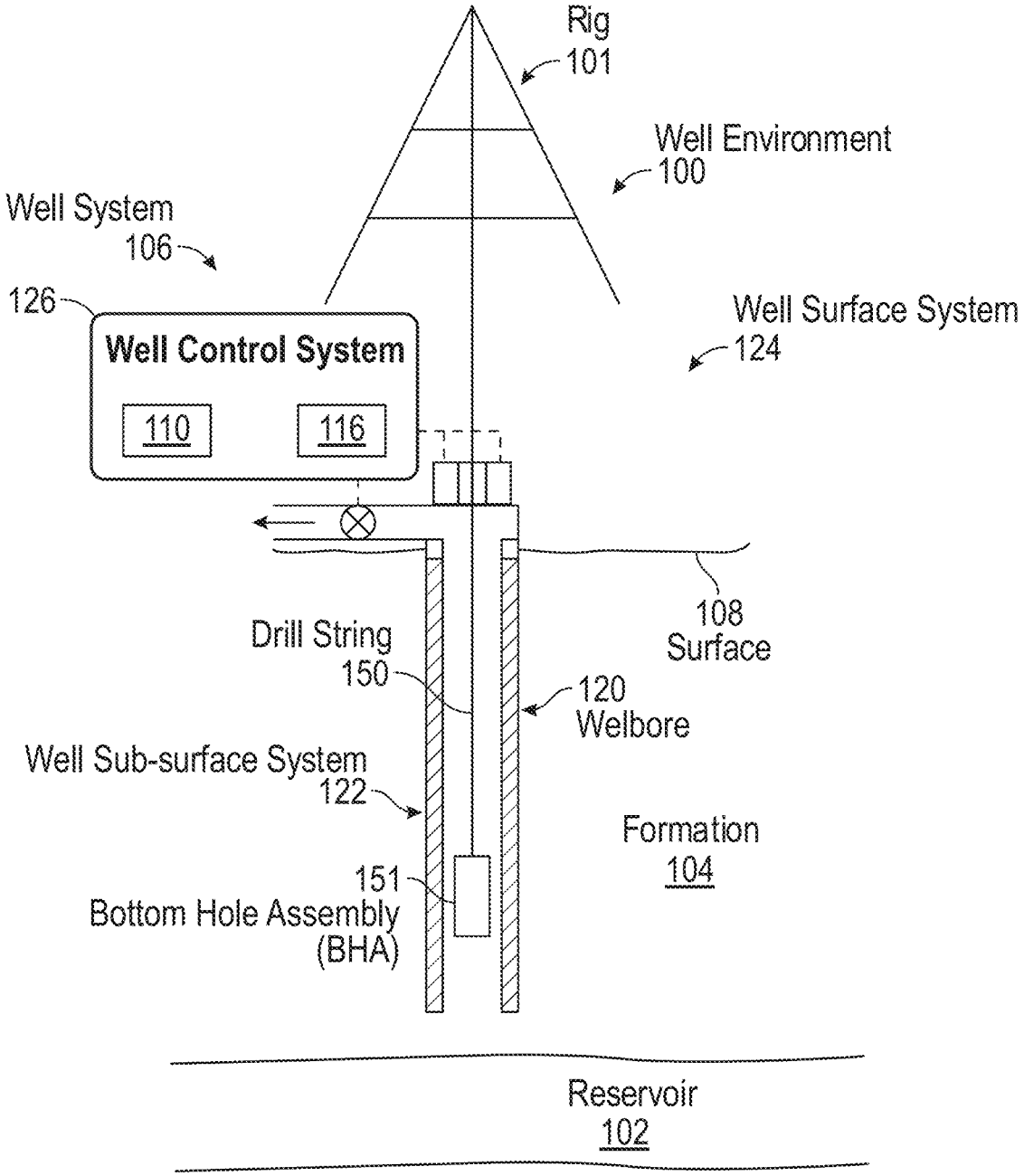
FIGS. 1 and 2A-2B show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Drilling the wellbore typically uses a drilling system disposed to penetrate from the surface of the earth or from a seabed (hereafter "surface") to the formation. Drilling the wellbore uses a rotating drill bit that removes rock in the form of cuttings. The rate at which the rock is removed may indicate the aggressiveness of the drill bit. The drill bit is deployed by and rotated by pipe sections that are sequentially joined to form a drill string as the drilled hole becomes deeper. The drill string rotates the drill bit typically in the clockwise direction about the drill string axis as viewed from the surface. The overall length of connected pipe sections can typically be 5,000 to 40,000 feet (ft) deep. A drilling fluid called mud is disposed by pumping it through the drill string and out the drill bit to cool the cutting action and to carry the drilled earthen material (termed "cuttings") up and out of the wellbore.

A common drill bit is cast metal or machined housing studded with multiple protrusions. The protrusions comprise a hard surfaced material, which may be a ceramic material that is fortified with multiple industrial diamonds. The resulting cutting discs are known in the industry as polycrystalline diamond compact (PDC) cutters. A PDC drill bit is a drilling tool that uses PDC cutters to shear rock with a continuous scraping motion. These cutters are synthetic diamond disks about ⅛-in (inch) thick and about ½ to 1-in diameter. Polycrystalline diamond compact (PDC) bits have static blades which are equipped with PDC cutters. The static blade is static with respect to the PDC bit body. In accordance with one or more embodiments the PDC cutters are primary cutters.

The drill bits are subject to wear. As the drill bit wears, it loses aggressiveness and eventually wears out. The rate of wear depends on the hardness and abrasion characteristics of the drilled earthen material. As wear progresses, the cutting discs become dull and less and less effective. To refresh the bit is to restore the aggressiveness by replacing the cutters with fresh, unworn cutters. This is typically done by changing the bit.

Another application for replacing the cutters is for during drilling when encountering a formation change in composition. A different type of cutter on the bit may be selected to optimize drilling performance in the composition. To refresh the bit is to restore aggressiveness by changing cutters to those appropriate to the composition. This is also typically done by changing the bit.

Changing bits to refresh the cutters or to change the cutters to a different type for the different rock, requires removing the drill string one pipe section at a time from the hole to access the bit. For example, a 9,000-foot deep well may require 300 pipe sections. Upon retrieval, the bit is removed, a new bit is attached, and the entire drill string is lowered back into the hole, one pipe section at a time.

Embodiments of this disclosure provide a refreshable PDC bit and a method for performing a drilling operation using the refreshable PDC bit. Embodiments of the system may include two broad variations, one for translating a replacement blade (a "translatable refreshing bit") and one for rotating the replacement blade (a "rotatable refreshing bit").

In one or more embodiments, the translatable refreshing bit includes a PDC bit body, and at least one PDC refreshing cutter disposed on a translatable refreshing blade that is coupled to a PDC static blade. The refreshing blade is disposed on the PDC static blade of the translatable refreshing bit such that in a substantially retracted rest position none, some, all, or a portion of the refreshing cutters engage the earthen material during drilling operation. The refreshing blade may move to a substantially extended rest position to engage some, all, or a portion of the cutters.

In one or more embodiments, the rotatable refreshing bit includes a PDC bit body, and at least one PDC refreshing cutter disposed on a rotatable refreshing blade that is coupled to a static blade. The refreshing blade is disposed on the static blade of the rotatable refreshing bit such that in a first rotated rest position none, some, all, or a portion of the refreshing cutters engage the earthen material during drilling operation. The refreshing blade may move to a second rotated rest position to engage some, all, or a portion of the cutters.

In one or more embodiments, the translatable refreshing blade may be translatably coupled to the static blade. In one or more embodiments, the rotatable refreshing blade may be rotatably coupled to the static blade. Those skilled in the art will appreciate that refreshing blades combining translation and rotation may be configured without departing from the scope of this disclosure. For example, refreshing cutters may be disposed on the rotatable blade that also translates into the substantially extended rest position. Alternatively, refreshing cutters may be disposed on the translatable blade that also rotates into the substantially extended rest position. The refreshing blades may translate and/or rotate more than one time and in different orders to arrive at the rest position. Alternatively, the refreshing blade may be coupled to the PDC bit body without departing from the scope of this disclosure.

In accordance with one or more embodiments the refreshing blade of the refreshable PDC bit has PDC cutters brazed to the refreshing blade to join the cutters to the blade. In particular, at least one refreshable cutter is disposed on the refreshing blade.

Those skilled in the art will appreciate that configurations of the primary and refreshing cutters may be different without departing from the scope of this disclosure. For example, the material grade and/or geometries of the primary cutters and refreshing cutters may be the same. Alternatively, the material grade of the primary cutters and refreshing cutters may be the same, while the geometries are different. In yet other embodiments, the material grade of the primary cutters and refreshing cutters may be different, while the geometries are the same. Those skilled in the art will appreciate that material grade may include material chemistry, material heat treatment, material manufacturing, and material coating.

The PDC bit is configured to drill with the primary cutters engaging the earthen material. The refreshable PDC bit may engage the refreshing blade to a rest position after the primary PDC cutters lose aggressiveness (i.e., become dull or worn out) or when encountering a formation rock change during drilling.

FIG. 1 shows a schematic diagram in accordance with one or more embodiments. As shown in FIG. 1, a well environment (100) includes a subterranean formation ("formation") (104) and a well system (106). The formation (104) may include a porous or fractured rock formation that resides underground, beneath the surface of the earth or beneath a seabed ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102) (hereafter "reservoir"). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well subsurface system (122), a well surface system (124), and a well control system (126). The well control system (126) may control various operations of the well system (106), such as well production operations, well drilling operations, well completion operations, well maintenance operations, and reservoir monitoring, assessment, and development operations. In one or more embodiments, the well control system (126) includes a computer system (110) and a computer processor (116).

The rig (101) is the machine used to drill a borehole to form the wellbore (120) by rotating a drilling bit. Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes the borehole that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of the drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the formation (104) or the reservoir (102) during injection operations, or facilitate the communication of monitoring devices (e.g., logging tools) lowered into the formation (104) or the reservoir (102) during monitoring operations (e.g., during in situ logging operations).

In one or more embodiments, the well system (106) is provided with a well sub-surface system (122) with a bottom hole assembly (BHA) (151) attached to the drill string (150) made of drill pipes to suspend into the wellbore (120) for performing the well drilling operation. The BHA (151) is the lowest part of the drill string (150) and includes the drill bit, drill collar, stabilizer, mud motor, etc. A mud motor is a drilling motor that uses hydraulic horsepower of the drilling fluid to rotate the drill bit during the drilling operation. Details of the BHA (151) are described in reference to FIG. 2 below.

Figure 2A:
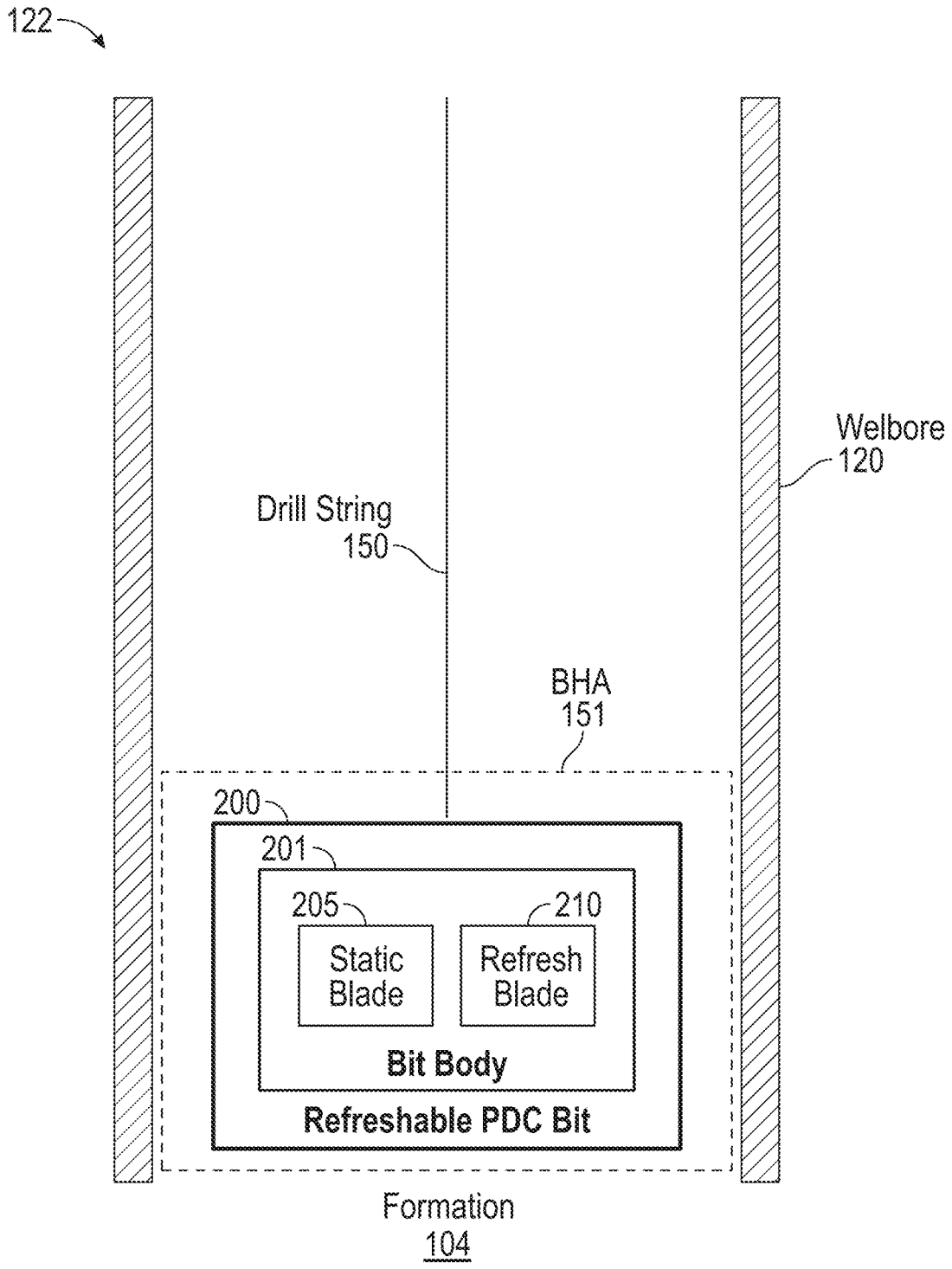
Figure 2B:
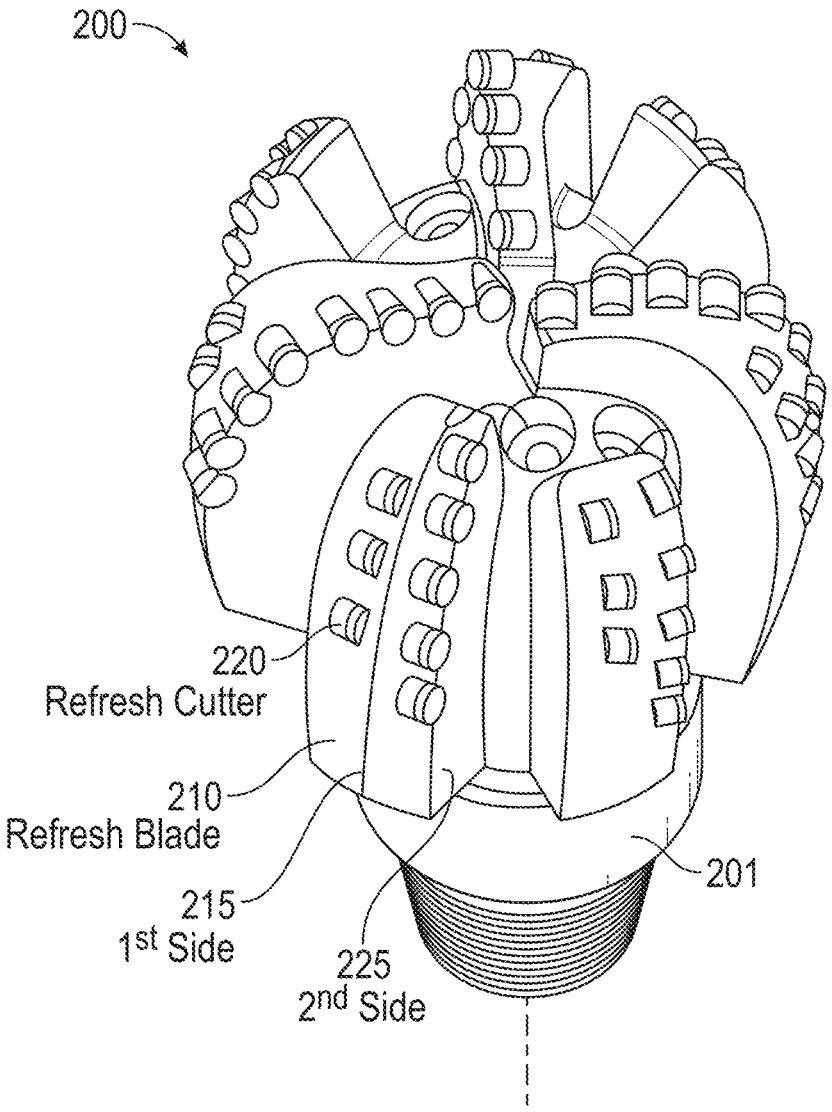

Turning to FIGS. 2A-2B, further details are illustrated of the BHA (151) suspended in the wellbore (120) in accordance with one or more embodiments disclosed herein. In one or more embodiments, one or more of the modules and/or elements shown in FIGS. 2A-2B may be omitted, repeated, combined and/or substituted. Accordingly, embodiments disclosed herein should not be considered limited to the specific arrangements of modules and/or elements shown in FIGS. 2A-2B.

As shown in FIG. 2A, the BHA (151) includes a refreshable polycrystalline diamond compact (PDC) bit (200) connected to a drill pipe such as a section of the drill string (150). The refreshable PDC bit (200) may be driven by a rotating drive surface motor, in which case the mud motor may be omitted. In one or more embodiments, the refreshable PDC bit (200) includes one or more blades such as a static blade (205) disposed on the bit body (201). In contrast to a conventional PDC bit that carries PDC cutters only on the static blade (205), the refreshable PDC bit (200) carries at least one additional blade with at least one refresh cutter or set of refresh cutters. The additional blade is named a refreshing blade (210). In particular, as shown in FIG. 2B, the at least one refreshing blade (210) is disposed on a static blade first side (215) and the at least one refresh cutter (220) or set of cutters is disposed on the refreshing blade (210). The static blade first side (215) is opposite the static blade second side (225) at an angle along a circumferential direction of the refreshable PDC bit (200).

Figure 3:
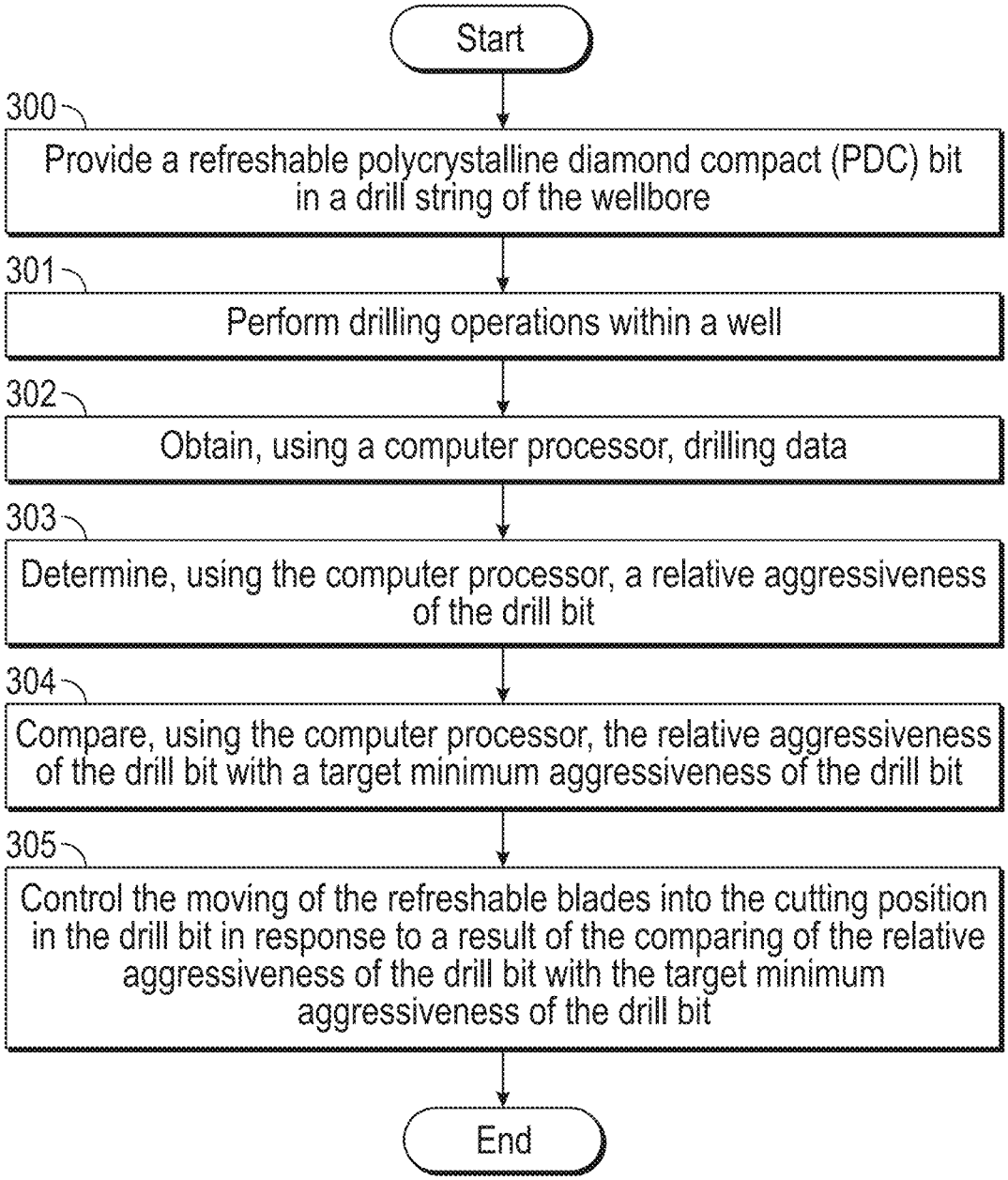
FIG. 3 shows a flowchart in accordance with one or more embodiments.

FIG. 3 depicts a flowchart illustrating a method for operating a refreshable drill bit using the refreshable PDC bit (200) according to one or more embodiments of the disclosure. Specifically, FIG. 3 illustrates a method for improving drilling performance of a well system (106) using drilling operational data obtained from one or more drilling systems in the well where the well includes at least one refreshable PDC bit (200). Computer instructions for causing the computer processor (116) to carry out the method outlined in FIG. 3 may be stored on a non-transitory computer readable medium for execution by the computer system (110). Further, one or more blocks in FIG. 3 may be performed by one or more components as described with respect to FIGS. 1 and 2A-2B. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a refreshable polycrystalline diamond compact bit is provided (300) using, for example, the drill string (150) of the well system (106).

Perform drilling operations within a wellbore (120) using the well system (106) (301).

Obtain (302), using the computer processor (116), drilling data from the well control system (126) and measurement devices. The drilling data from the control system includes, but is not limited to, hydrostatic pressure, pump rate, fluid properties, rate of penetration, weight on bit, vibration, and torque. The drilling data from the measurement devices, such as measurement while drilling tool or logging while drilling tool, includes formation information, seismic information, formation fluid, formation resistivity, borehole azimuth, borehole inclination, etc. Well control systems may include commercial software packages such as NOVOS™ or Amphion™. This list is not intended to be limiting, nor are the determinations intended to be limited to these commercially available programs. Any suitable software (e.g., custom-coded applications) and/or hardware providing similar functionality to that described may also be implemented without departing from the scope of the present disclosure.

Determine, using the computer processor, a relative aggressiveness of the drill bit (303). Commercial software such as DELFI™ Drilling Interpretation software may calculate associated wear.

Relative indication of bit wear can be ascertained through, for example, this equation from Teale (1965) in which Mechanical Specific Energy is calculated.

$$MSE = \frac{\text{Work done}}{\text{Volume of rock removed}} = \frac{W}{A_{bit}} + 120\pi\frac{N \cdot T}{A_{bit} \cdot PR}$$

W is the weight on bit ($lb_f$) (pounds-force), $A_{bit}$ is the surface area of the bit ($in^2$) (square inches), N is the rotary speed (rpm) (revolutions per minute), T is the torque at bit (ft·lb) (foot-pounds) and PR is the penetration rate (ft/hr) (feet per hour). The unit of MSE in the above equation is $$\frac{lb_f \cdot in}{in^3}$$

or psi (pounds-force per square inch).

The Teale equation shows that the smaller the amount of rock removed, the greater the amount of energy required to remove it. The determination of the relative aggressiveness may be made by monitoring the trend of energy used to remove the rock. As the amount of energy increases, the trend may correlate with bit wear.

A limit may be set for a specified volume of rock removed at a specified amount of work done. Further, a determination may be made that upon reaching the limit that the drill bit is worn. The algorithm may be further refined by accounting for coefficient of sliding friction, hydrostatic pressure, rate of penetration, weight on bit, and torque at bit. The Teale equation may also be correlated to lithology prediction. Thus, the next step in the method is to compare, using the computer processor (116), the relative aggressiveness of the drill bit with a target minimum aggressiveness of the drill bit (304). The quantification of relative aggressiveness in the specific well being drilled may be derived by an empirical process in which drilling data is compared with offset wells. The drilling data may include the rate of penetration for a given set of drilling operation conditions. Those skilled in the art will readily appreciate that the term "offset well" is a drilling term meaning an existing wellbore close in proximity to the well that is being drilled and that provides information for drilling the well being drilled.

In response to a result of the comparing, such as upon determining that the aggressiveness has fallen to at or below the target minimum aggressiveness, then the system may control the moving of the refreshable blades into the cutting position in the drill bit (305). The signal to be sent to the system for moving the refreshable blades may use commercial technologies either alone or in any combination such as wired drill pipe, mud pulse triggered system, mud flow rate triggered system, or object-dropping intervention method. The object-dropping intervention method may be further categorized into mechanical, electrical, magnetic, or acoustic mechanism, or a combination of these. This list is not intended to be limiting, nor are the determinations intended to be limited to any commercially available program. Any suitable software (e.g., custom-coded applications) and/or hardware combination providing similar functionality to that described may also be implemented without departing from the scope of the present disclosure.

FIGS. 4A, 4B, 5A, and 5B show examples of the refreshable PDC bits. The top of each figure shows the downhole end of the drill bit. The refreshable PDC bit (200) comprises a generally cylindrical tubular tool body (201) with a flowbore (405) extending there through. The tool body (201) includes upper connection (410) for connecting the refreshable PDC bit (200) into the BHA (151 FIG. 1). At approximately the longitudinal top (415) of the tool body (201) and on the static blade first side (215), one or more cavities (425) are formed in the static blade first side (215). The one or more cavities (425) accommodate the movement of the refreshing blades (210) that move in or out of the cavities (425) or rotate within the cavities (425). Each cavity (425) stores at least one refreshing blade (210). In accordance with one or more embodiments the translatable refreshing bit (200) is shown with a translatable refreshing blade (210) in a substantially retracted rest position (400) in FIG. 4A and in a substantially extended rest position (402) in FIG. 4B. Likewise, the rotatable refreshing bit (200) is shown with a rotatable refreshing blade (210) in a first rotated rest position (500) in FIG. 5A and in a second rotated rest position (502) in FIG. 5B.

Figure 4A:
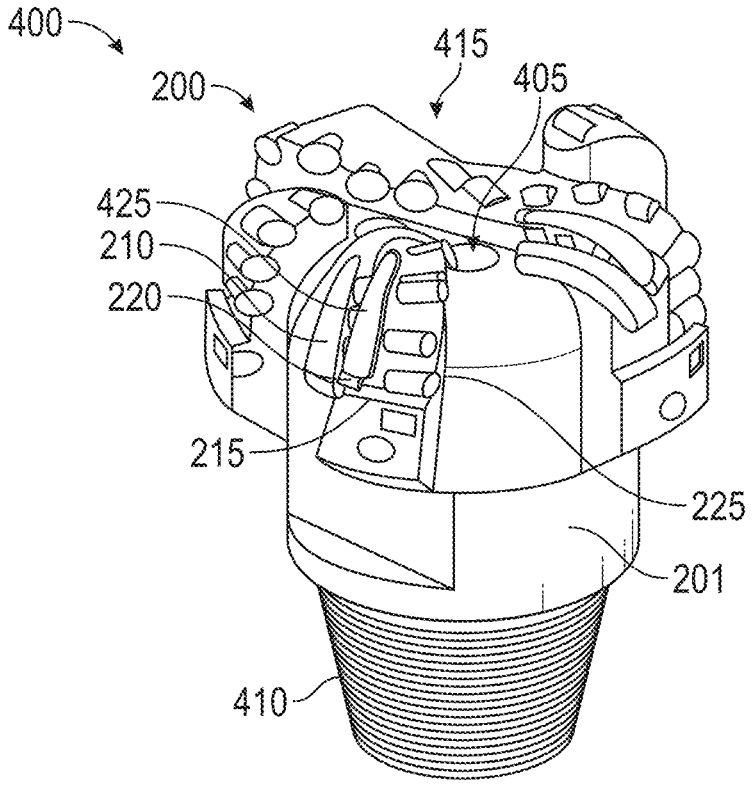
FIGS. 4A and 4B show examples in accordance with one or more embodiments.
Figure 4B:
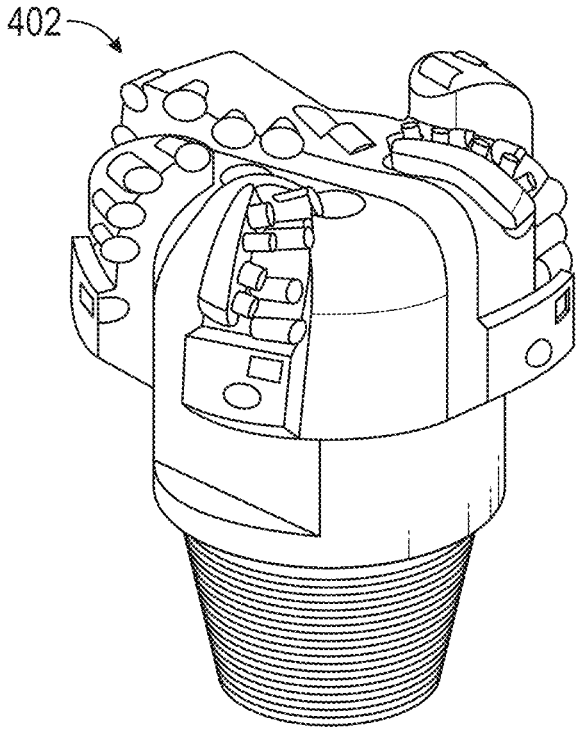

The translatable refreshing blade shown in FIGS. 4A and 4B may be translatably coupled to the PDC static blade. The means of coupling may include fasteners such as studs, nuts, screws, bolts, and pins engaging the blade, e.g., through a hole or slot in the blade. The coupling may further use a dovetail slot on one or both of the translatable refreshing blade or the bit body and a mating dovetail rail on the other of the translatable refreshing blade or the bit body. The coupling may include one or more sliding bearings such as a ball bearing, cylindrical roller bearing, spherical roller bearing, tapered roller bearing, and/or journal bearing on one or both of the translatable refreshing blade or the bit body and a mating sliding surface. The means for translating may include one or more motors, linear actuators, electromagnets, solenoids, hydraulic cylinders, gears, levers, or jack screws and/or latches, locks, or braking mechanisms. Those skilled in the art will readily appreciate that the means for coupling and the means for translating combining fasteners, bearings, and actuators may be configured without departing from the scope of this disclosure.

Figure 5B:
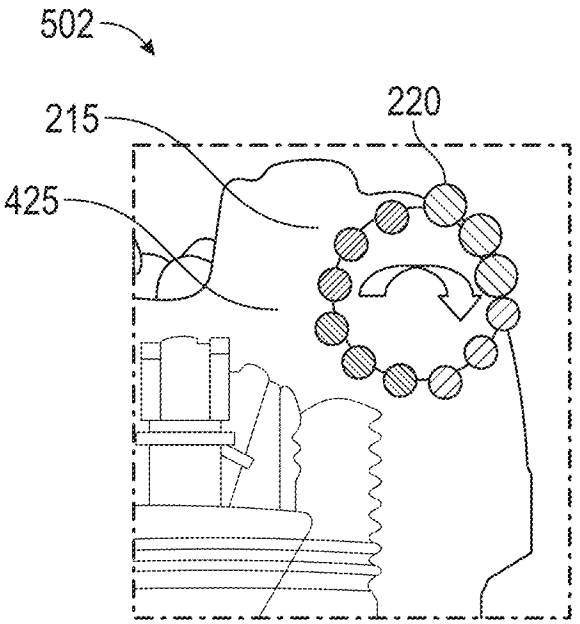
FIGS. 5A and 5B show examples in accordance with one or more embodiments.
Figure 5A:
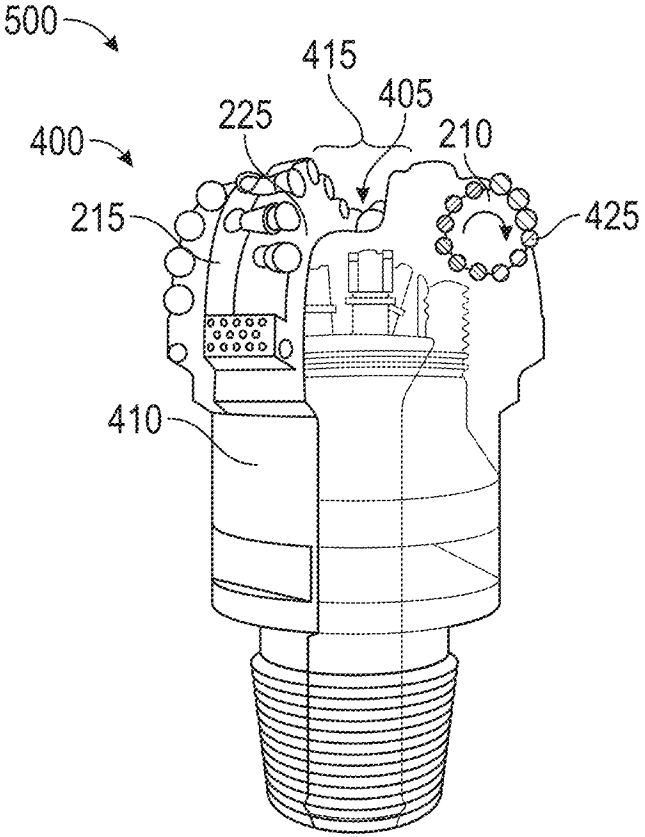

The rotatable refreshing blade shown in FIGS. 5A and 5B may be rotatably coupled to the PDC static blade. The means of coupling may include fasteners such as studs, nuts, screws, bolts, and pins engaging the blade, e.g., through a hole or slot in the blade. The coupling may include one or more rotatable bearings such as a ball bearing, cylindrical roller bearing, spherical roller bearing, tapered roller bearing, and/or journal bearing on one or both of the rotatable refreshing blade or the bit body and a mating shaft or axle, pin, stud or rod on the other of the rotatable refreshing blade or the bit body. The means for rotating may include one or more motors, linear actuators, electro-magnets, solenoids, hydraulic cylinders, gears, or jack screws and/or latches, locks, or braking mechanisms. Those skilled in the art will readily appreciate that the means for coupling and the means for translating combining fasteners, bearings, and actuators may be configured without departing from the scope of this disclosure.

Upon receipt of a signal such as from a well control system (126), the means for translating translates the translatable refreshing blade and/or the means for rotating rotates the rotatable refreshing blade. Translating the translatable refreshing blade or rotating the rotatable refreshing blade may include sliding, rotating, or otherwise extending from the body the translatable refreshing blade or the rotatable refreshing blade into the substantially extended rest position and/or into the second rotated rest position. In accordance with one or more embodiments the translatable refreshing bit may include a translation restricting device, such as a latch, lock, or brake mechanism, that may prevent the translatable blade from translating when no signal is received, until a signal is received, when a signal is received to engage the restricting device, and/or when no signal is received to disengage the latch. As used herein, "when" may be interpreted as meaning at the time the signal is received, shortly thereafter, or some specified period of time thereafter.

Figure 6:
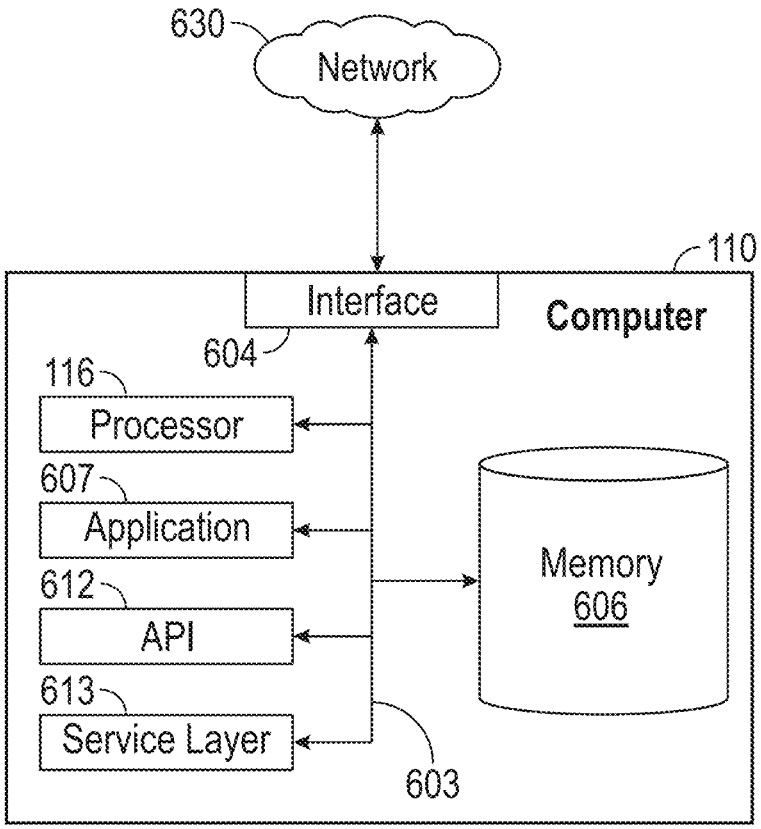
FIG. 6 is a block diagram of a computer in accordance with one or more embodiments.

FIG. 6 is a block diagram of a computer (110) used to provide computational functionalities associated with described algorithms, methods, functions, processes, flows, and procedures as described in the instant disclosure, according to an implementation. The illustrated computer (110) is intended to encompass any computing device such as a server, desktop computer, laptop/notebook computer, wireless data port, smart phone, personal digital assistant (PDA), tablet computing device, one or more processors within these devices, or any other suitable processing device, including both physical or virtual instances (or both) of the computing device. Additionally, the computer (110) may include a computer that includes an input device, such as a keypad, keyboard, touch screen, or other device that can accept user information, and an output device that conveys information associated with the operation of the computer (110), including digital data, visual, or audio information (or a combination of information), or a GUI.

The computer (110) can serve in a role as a client, network component, a server, a database or other persistency, or any other component (or a combination of roles) of a computer for performing the subject matter described in the instant disclosure. The illustrated computer (110) is communicably coupled with a network (630). In some implementations, one or more components of the computer (110) may be configured to operate within environments, including cloud-computing-based, edge, fog, local, global, or other environment (or a combination of environments).

At a high level, the computer (110) is an electronic computing device operable to receive, transmit, process, store, or manage data and information associated with the described subject matter. According to some implementations, the computer (110) may also include or be communicably coupled with an application server, e-mail server, web server, caching server, streaming data server, business intelligence (BI) server, or other server (or a combination of servers).

The computer (110) can receive requests over network (630) from a client application (for example, executing on another computer (110)) and responding to the received requests by processing the said requests in an appropriate software application. In addition, requests may also be sent to the computer (110) from internal users (for example, from a command console or by other appropriate access method), external or third-parties, other automated applications, as well as any other appropriate entities, individuals, systems, or computers.

Each of the components of the computer (110) may communicate using a system bus (603). In some implementations, any or all of the components of the computer (110), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (110) or other components (whether or not illustrated) that are communicably coupled to the computer (110).

The functionality of the computer (110) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or another suitable format. While illustrated as an integrated component of the computer (110), alternative implementations may illustrate the API (612) or the service layer (613) as stand-alone components in relation to other components of the computer (110) or other components (whether or not illustrated) that are communicably coupled to the computer (110). Moreover, any or all parts of the API (612) or the service layer (613) may be implemented as child or sub-modules of another software module, enterprise application, or hardware module without departing from the scope of this disclosure.

The computer (110) includes an interface (604). Although illustrated as a single interface (604) in FIG. 6, two or more interfaces (604) may be used according to particular desires or implementations of the computer (110). The interface (604) is used by the computer (110) for communicating with other systems in a distributed environment that are connected to the network (630). Generally, the interface (604) includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (110).

The computer (110) includes at least one computer processor (116). Although illustrated as a single computer processor (116) in FIG. 6, two or more processors may be used according to particular needs, desires, or particular implementations of the computer (110). Generally, the computer processor (116) executes instructions and manipulates data to perform the operations of the computer (110) and any algorithms, methods, functions, processes, flows, and procedures as described in the instant disclosure.

The computer (110) also includes a memory (606) that holds data for the computer (110) or other components (or a combination of both) that can be connected to the network (630). For example, memory (606) can be a database storing data consistent with this disclosure. Although illustrated as a single memory (606) in FIG. 6, two or more memories may be used according to particular desires implementations of the computer (110) and the described functionality. While memory (606) is illustrated as an integral component of the computer (110), in alternative implementations, memory (606) can be external to the computer (110).

An application (607) is an algorithmic software engine providing functionality according to particular needs, desires, or particular implementations of the computer (110), particularly with respect to functionality described in this disclosure. For example, application (607) can serve as one or more components, modules, applications, etc. Further, although illustrated as a single application (607), the application (607) may be implemented as multiple applications (607) on the computer (110). In addition, although illustrated as integral to the computer (110), in alternative implementations, the application (607) can be external to the computer (110).

There may be any number of computers (110) associated with, or external to, a computer system containing computer (110), each computer (110) communicating over network (630). Further, the term "client," "user," and other appropriate terminology may be used interchangeably as appropriate without departing from the scope of this disclosure. Moreover, this disclosure contemplates that many users may use one computer (110), or that one user may use multiple computers (110).

What is claimed is:

1. A cutter system for a polycrystalline diamond compact (PDC) drill bit, the cutter system comprising:

a body;

a static blade attached to the body;

a rotatable blade attached to the body comprising a plurality of cutters circumferentially disposed around a circumference of the rotatable blade; and at least one PDC cutting structure attached to the rotatable blade, wherein the rotatable blade is configured to be rotated and maintained in a rotated position, wherein the body includes a cavity cooperatively positioned angularly away from the static blade, wherein the rotatable blade is rotatable about an axis relative to the body, such that a portion of the plurality of cutters is recessed within the cavity while a remaining portion of the plurality of cutters is exposed relative to the cavity, wherein rotation of the rotatable blade exchanges the portion recessed and the remaining portion exposed, wherein the rotatable blade has at least one incrementally rotated rest position, and wherein the cavity includes a restricting device within said cavity, so that said restricting device engages the rotatable blade in the incrementally rotated position.

2. The cutter system of claim 1, wherein the rotatable blade is selectively rotated.

3. The cutter system of claim 2, wherein the rotatable blade is selectively rotated when a signal is received, wherein the signal may be mechanical, hydraulic, electrical-mechanical, or wireless.

4. The cutter system of claim 1, wherein said PDC cutting structure is braze-fitted to the blade.

5. The cutter system of claim 1, wherein the restricting device is at least one of a motor, a linear actuator, an electro-magnet, a solenoid, a hydraulic cylinder, a gear, a jack screw, a latch, a lock, or a braking mechanism.

6. A cutter system for a polycrystalline diamond compact (PDC) drill bit, the cutter system comprising:

a body;

a static blade attached to the body;

a rotatable blade attached to the body comprising a plurality of cutters circumferentially disposed around a circumference of the rotatable blade; and at least one PDC cutting structure attached to the rotatable blade, wherein the body defining a cavity receiving the rotatable blade and cooperatively positioned angularly away from the static blade, wherein the rotatable blade is rotatable about an axis relative to the body through a complete revolution within the cavity, such that the plurality of cutters continuously rotate relative to the body and are maintained in a selected rotational orientation, wherein the rotatable blade has at least one incrementally rotated rest position, and wherein the cavity includes a restricting device within said cavity, so that said restricting device engages the rotatable blade in the incrementally rotated rest position.

7. The cutter system of claim 6, wherein the rotatable blade is selectively rotated.

8. The cutter system of claim 7, wherein the rotatable blade is selectively rotated when a signal is received, wherein the signal may be mechanical, hydraulic, electrical-mechanical, or wireless.

9. The cutter system of claim 6, wherein said PDC cutting structure is braze-fitted to the blade.

10. The cutter system of claim 6, wherein the restricting device is at least one of a motor, a linear actuator, an electro-magnet, a solenoid, a hydraulic cylinder, a gear, a jack screw, a latch, a lock, or a braking mechanism.

* * * * *